US011250802B2

(12) United States Patent
Zhou et al.

(10) Patent No.: US 11,250,802 B2
(45) Date of Patent: Feb. 15, 2022

(54) DRIVING METHOD, DRIVING DEVICE, AND DISPLAY DEVICE

(71) Applicants: Hefei Boe Display Technology Co., Ltd., Anhui (CN); BOE Technology Group Co., Ltd., Beijing (CN)

(72) Inventors: Liugang Zhou, Beijing (CN); Yifang Chu, Beijing (CN); Shou Li, Beijing (CN)

(73) Assignees: Hefei Boe Display Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 421 days.

(21) Appl. No.: 16/328,934

(22) PCT Filed: Jul. 27, 2018

(86) PCT No.: PCT/CN2018/097601
§ 371 (c)(1),
(2) Date: Feb. 27, 2019

(87) PCT Pub. No.: WO2019/076098
PCT Pub. Date: Apr. 25, 2019

(65) Prior Publication Data

US 2021/0174756 A1 Jun. 10, 2021

(30) Foreign Application Priority Data

Oct. 19, 2017 (CN) ..... 201710996605.4

(51) Int. Cl.
*G09G 3/36* (2006.01)

(52) U.S. Cl.
CPC ..... *G09G 3/3648* (2013.01); *G09G 3/3674* (2013.01); *G09G 3/3685* (2013.01); *G09G 2320/0233* (2013.01)

(58) Field of Classification Search
CPC .. G09G 3/3648; G09G 3/3674; G09G 3/3685; G09G 2320/0233
See application file for complete search history.

(56) References Cited

U.S. PATENT DOCUMENTS

2010/0245326 A1* 9/2010 Xiao ..... G09G 3/3655 345/211
2012/0081410 A1* 4/2012 Yeo ..... G09G 3/2092 345/690

(Continued)

FOREIGN PATENT DOCUMENTS

CN 101071545 A 11/2007
CN 101847376 A 9/2010

(Continued)

OTHER PUBLICATIONS

Office Action for corresponding Chinese Application 201710996605.4 dated Mar. 29, 2019.

(Continued)

*Primary Examiner* — Benyam Ketema
(74) *Attorney, Agent, or Firm* — Arent Fox LLP; Michael Fainberg

(57) ABSTRACT

The disclosure discloses a method and apparatus for driving a display panel, and a display device. A method for driving a display panel according to an embodiment of this disclosure includes: determining a charging length of time of the current row of pixels; determining a common voltage value corresponding to the charging length of time; and driving the current row of pixels using the common voltage value.

12 Claims, 4 Drawing Sheets

(56) References Cited

U.S. PATENT DOCUMENTS

| | | | | |
|---|---|---|---|---|
| 2014/0085345 | A1* | 3/2014 | Ma | G09G 3/3696 345/690 |
| 2014/0092077 | A1* | 4/2014 | Kim | G09G 3/3655 345/212 |
| 2015/0287382 | A1* | 10/2015 | Lee | G09G 3/3666 345/206 |
| 2016/0063960 | A1 | 3/2016 | Pyun et al. | |
| 2016/0247470 | A1 | 8/2016 | Tan | |
| 2016/0282689 | A1* | 9/2016 | Zhang | G02F 1/134309 |
| 2017/0372671 | A1 | 12/2017 | Wu | |

FOREIGN PATENT DOCUMENTS

| | | | |
|---|---|---|---|
| CN | 102768817 | A | 11/2012 |
| CN | 103676360 | A | 3/2014 |
| CN | 103745694 | A | 4/2014 |
| CN | 105895041 | A | 8/2016 |
| CN | 106710504 | A | 5/2017 |
| CN | 106875905 | A | 6/2017 |
| CN | 107068086 | A | 8/2017 |
| CN | 107665686 | A | 2/2018 |
| JP | H0566386 | A | 3/1993 |
| JP | H1114968 | A | 1/1999 |
| KR | 20160025141 | A | 3/2016 |
| TW | 200807364 | A | 2/2008 |

OTHER PUBLICATIONS

International Search Report for PCT/CN2018/097601 dated Oct. 23, 2018.

Office Action for corresponding Chinese Application 201710996605.4 dated May 27, 2019.

* cited by examiner

| t | $V_{com}$ |
|---|---|
| t1 | V1 |
| t2 | V2 |
| t3 | V3 |
| t4 | V4 |
| ⋮<br>tn<br>⋮ | ⋮<br>Vn<br>⋮ |
| tn+1 | Vn+1 |

DRIVING METHOD, DRIVING DEVICE, AND DISPLAY DEVICE

This application is a National Stage of International Application No. PCT/CN2018/097601, filed on Jul. 27, 2018, which claims the priority of Chinese Patent Application No. 201710996605.4, filed with the Chinese Patent Office on Oct. 19, 2017, and entitled "A driving method, a driving device, and a display device", both of which are hereby incorporated by reference in their entireties.

FIELD

This disclosure relates to the field of display technologies, and particularly to a driving method, a driving device, and a display device.

BACKGROUND

Since wires in a liquid crystal panel are positioned differently, there is such a difference between charging of pixels at a shorter distance from a source driver and a gate driver, and charging of pixels at a longer distance from a source driver and a gate driver that the pixels at a longer distance from the source driver and the gate driver receive a driving signal at a different instance of time from the pixels at a shorter distance from the source driver and the gate driver due to a delay of the signal over the wires.

SUMMARY

Embodiments of this disclosure provide a driving method, a driving device, and a display device in the following particular solutions.

An embodiment of this disclosure provides a method for driving a display panel, the method including:

determining a charging length of time of a current row of pixels;

determining a common voltage value corresponding to the charging length of time; and driving the current row of pixels using the common voltage value.

Optionally, in the method above for driving a display panel according to the embodiment of this disclosure, determining the charging length of time of the current row of pixels includes:

calculating the charging length of time of the current row of pixels at least one of following parameters:

a distance between the current row of pixels and a gate driver and/or a source driver on a main board; and a difference in brightness between the current row of pixels and a preceding row of pixels.

Optionally, in the method above for driving a display panel according to the embodiment of this disclosure, determining the common voltage value corresponding to the charging length of time includes:

determining a digital signal of common voltage corresponding to the charging length of time; and converting the digital signal into an analog signal.

Optionally, in the method above for driving a display panel according to the embodiment of this disclosure, determining the digital signal of common voltage corresponding to the charging length of time includes:

determining a charging length of time interval including the charging length of time of the current row of pixels; and determining the digital signal of common voltage corresponding to the current row of pixels according to a correspondence relationship between charging length of time intervals, and digital signals of common electrode.

Optionally, in the method above for driving a display panel according to the embodiment of this disclosure, the correspondence relationship is set by:

determining a difference Δt between a maximum charging length of time tmax and a minimum charging length of time tmin;

dividing Δt into n charging length of time intervals, wherein n is equal to or greater than 2; and setting a corresponding digital signal of common voltage for each charging length of time interval.

Optionally, in the method above for driving a display panel according to the embodiment of this disclosure, the method further includes: in response to that the charging length of time of a succeeding row of pixels is same with that of the current row of pixels, driving the succeeding row of pixels using the common voltage value for driving the current row of pixels.

Correspondingly, an embodiment of this disclosure provides an apparatus for driving a display panel, the apparatus including:

a charging time length determining module configured to determine a charging length of time of the current row of pixels;

a common voltage value determining module configured to determine a common voltage value corresponding to the charging length of time; and a pixel driving module configured to drive the current row of pixels using the common voltage value.

Optionally, in the apparatus above for driving a display panel according to the embodiment of this disclosure, the charging time length determining module includes:

a data receiving circuit configured to receive at least one of following parameters:

a distance between the current row of pixels, and a gate driver and/or a source driver on a main board; and a difference in brightness between the current row of pixels, and a preceding row of pixels; and a data calculating circuit configured to calculate the charging length of time of the current row of pixels according to at least one of the parameters above.

Optionally, in the apparatus above for driving a display panel according to the embodiment of this disclosure, the common voltage value determining module includes:

a digital signal determining circuit configured to determine a digital signal of common voltage corresponding to the charging length of time; and a digital-analog conversion circuit configured to convert the digital signal into an analog signal.

Optionally, in the apparatus above for driving a display panel according to the embodiment of this disclosure, the digital signal determining circuit is configured:

to determine a charging length of time interval including the charging length of time of the current row of pixels; and to determine the digital signal of common voltage corresponding to the current row of pixels according to a correspondence relationship between charging length of time intervals, and digital signals of common electrode.

Optionally, in the apparatus above for driving a display panel according to the embodiment of this disclosure, the digital signal determining circuit is further configured to set the correspondence relationship by:

determining a difference Δt between a maximum charging length of time tmax and a minimum charging length of time tmin dividing Δt into n charging length of time intervals, wherein n is equal to or greater than 2; and setting a corresponding digital signal of common voltage for each charging length of time interval.

Optionally, in the apparatus above for driving a display panel according to the embodiment of this disclosure, the pixel driving module is further configured:

in response to that charging length of time of a succeeding row of pixels is same with that of the current row of pixels, to drive the succeeding row of pixels using the common voltage value for driving the current row of pixels.

An embodiment of this disclosure provides an apparatus for driving a display panel, the apparatus including:

a memory configured to store program instructions; and a processor configured to invoke the program instructions stored in the memory, and to perform the method above according to the program.

An embodiment of this disclosure provides a computer storage medium storing computer executable instructions configured to make the computer to perform the method above.

Correspondingly an embodiment of this disclosure provides a display device including the driving apparatus above.

DETAILED DESCRIPTION OF THE EMBODIMENTS

In order to make the objects, technical solutions, and advantages of the embodiments of this disclosure more apparent, this disclosure will be described below in further details with reference to the drawings, and apparently the embodiments to be described below are only a part but not all of the embodiments of this disclosure. Based upon the embodiments here of this disclosure, all the other embodiments which can occur to those ordinarily skilled in the art without any inventive effort shall fall into the scope of this disclosure.

Figure 1:
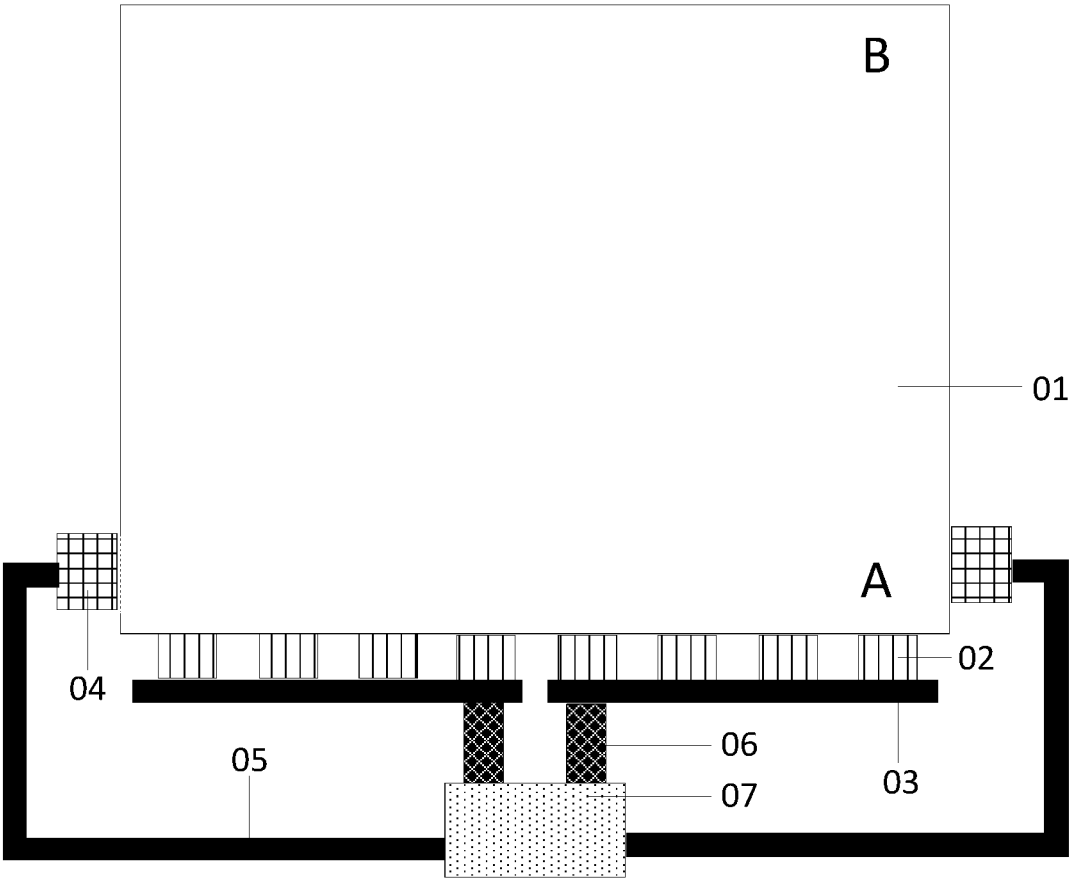
FIG. 1 is a schematic diagram of the relationship between the pixels of the display panel, and the source drivers and the gate drivers in the related art.

As illustrated in FIG. 1, if the pixels on the display panel 01 are charged for the same charging length of time, then there will be different relative brightness at a proximate end A closer to a source driver 02 and agate driver 04, and a distal end B further from the source driver 02 and the gate driver 04, so a period of time for charging the pixel elements at a shorter distance from the source driver 02 and the gate driver 04 (e.g., at the end A) is shortened by some length of time, and the pixel elements at a longer distance from the source driver 02 and the gate driver 04 (e.g., at the end B) by the length of time in the related art to thereby compensate for insufficient charging of the pixel elements at a longer distance from the source driver 02 and the gate driver 04 due to a delay over the wires in the display panel, thus making the brightness of the image more uniform. In FIG. 1, '07' refers to a Timing Controller (T-CON), the source driver 02 is connected on the T-CON 07 through a wire board 03 and a metal wire 06, and the gate driver 04 is connected on the T-CON 07 through a signal wire 05.

With the charging compensation technology, the period of time for charging the pixel elements at a shorter distance from the source driver and the gate driver is shortened by some length of time, and the pixel elements at a longer distance from the source driver and the gate driver by the length of time to thereby compensate for insufficient charging of the pixel elements at a longer distance from the source driver and the gate driver due to a delay over the wires in the display panel, thus making the brightness of the image more uniform. However flicking of the image may vary with a varying charging length of time in the charging compensation technology; since different rows of pixels are charged for different lengths of time, voltage applied across the pixels may become positive and negative alternately; and there is such a difference between the positive voltage and the negative voltage that there may be different brightness on the display panel at the positive voltage and the negative voltage, thus resulting in flicking on the display panel.

Figure 2:
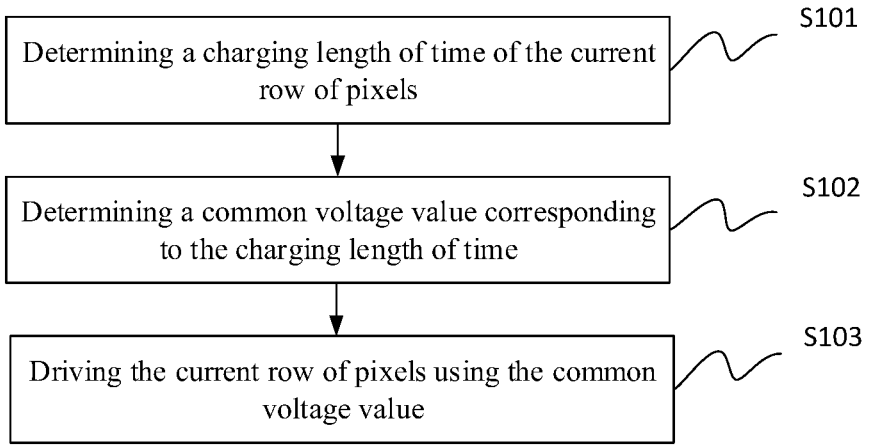
FIG. 2 is a schematic flow chart of a method for driving a display panel according to an embodiment of this disclosure.

As illustrated in FIG. 2, a method for driving a display panel according to an embodiment of this disclosure particularly includes the following steps.

The step S101 is to determine a charging length of time of the current row of pixels.

The step S102 is to determine a common voltage value corresponding to the charging length of time.

The step S103 is to drive the current row of pixels using the common voltage value.

Furthermore, in an optional implementation, in the method above for driving a display panel according to the embodiment of this disclosure, there is the same charging length of time of each row of pixels.

Furthermore, in an optional implementation, in the method above for driving a display panel according to the embodiment of this disclosure, the charging length of time of the current row of pixels can be determined by calculating the charging length of time of the current row of pixels according to at least one of the following parameters:

a distance parameter, i.e., the distance between the current row of pixels, and a gate driver and/or a source driver on a main board; and a difference parameter, i.e., the difference in brightness between the current row of pixels, and a preceding row of pixels.

Examples will be given below.

First Example the range of an adjustable charging period of time of each row is set, i.e., a maximum charging length of time tmax and a minimum charging length of time tmin are set, and a charging length of time of each row of pixels is calculated according to a distance parameter between the current row of pixels, and a source driver and/or a gate driver; and optionally, the charging length of time of each row of pixels can be further calculated as needed in reality.

Second Example the range of an adjustable charging period of time of each row is set, i.e., a maximum charging length of time tmax and a minimum charging length of time tmin are set, the difference in brightness data between the current row of pixels, and the preceding row of pixels, and a charging length of time of each row of pixels can be further calculated as needed in reality.

Third Example in a combination of the first and second examples, weights are set for the distance parameter and the difference parameter as needed in reality, and a charging length of time of each row of pixels is calculated according to these two parameters and their corresponding weights.

It shall be noted that calculation of a charging length of time of pixels will not be limited to the three examples above, but can be designed as needed as long as charging lengths of time of different pixels are determined accurately.

Furthermore, in an optional implementation, in the method above for driving a display panel according to the embodiment of this disclosure, determining the common voltage value corresponding to the charging length of time particularly includes:

determining a digital signal of common voltage corresponding to the charging length of time; and converting the digital signal into an analog signal.

Optionally, a correspondence relationship table between charging lengths of time of pixels, and digital signals of common electrode is set and stored in a digital signal determining circuit, and after the charging length of the current row of pixels is determined in the step S101, the correspondence relationship table between charging lengths of time of pixels, and digital signals of common electrode is searched for the digital signal of common voltage corresponding to the determined charging length of time, and the digital signal of common voltage is further input to a digital-analog conversion circuit, and converted into the corresponding analog signal of common electrode, thus resulting in the real common voltage value corresponding to the charging length of time of the current row of pixels in the step S102.

Furthermore, in an optional implementation, in the method above for driving a display panel according to the embodiment of this disclosure, determining a digital signal of common voltage corresponding to the charging length of time optionally includes:

determining a charging length of time interval including the charging length of time of the current row of pixels; and determining the digital signal of common voltage corresponding to the current row of pixels according to a correspondence relationship between charging length of time intervals, and digital signals of common electrode.

Furthermore, in an optional implementation, in the method above for driving a display panel according to the embodiment of this disclosure, the correspondence relationship is determined as follows:

determining the difference Δt between a maximum charging length of time tmax, and a minimum charging length of time tmin; and dividing Δt into n charging length of time intervals, where n is equal to or greater than 2.

Figure 3:
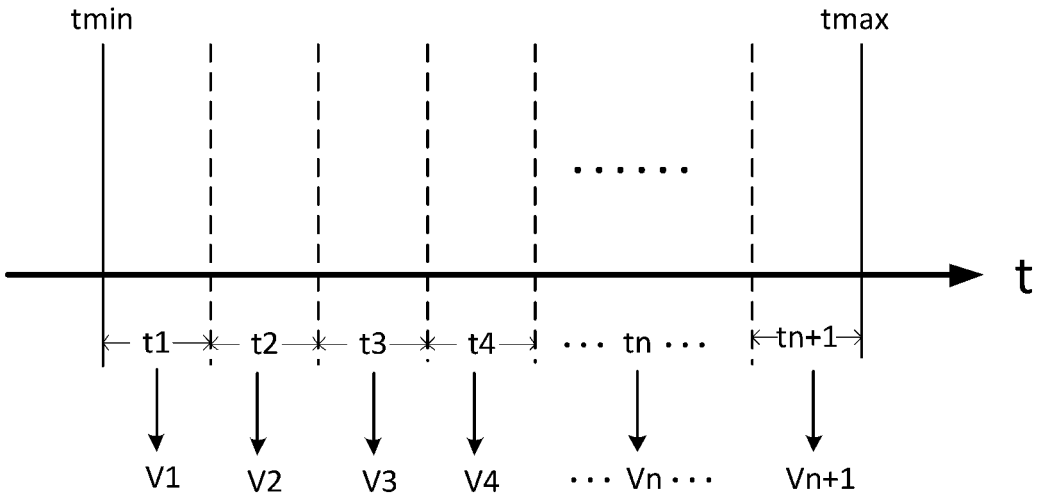
FIG. 3 is a schematic diagram of charging length of time intervals in a method for driving a display panel according to an embodiment of this disclosure.
Figures 4, 5:
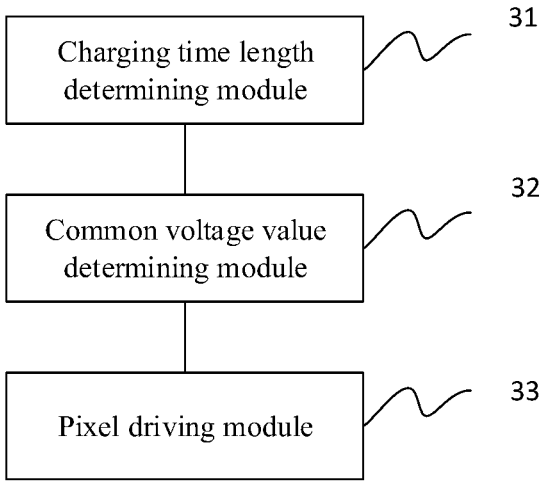
FIG. 4 is a schematic diagram of a correspondence relationship table between charging lengths of time, and common voltage digital signals in a method for driving a display panel according to an embodiment of this disclosure.
FIG. 5 is a schematic structural diagram of an apparatus for driving a display panel according to an embodiment of this disclosure.

Optionally, referring to FIG. 3, a maximum charging length of time tmax, and a minimum charging length of time tmin are set for all the pixels, so the difference Δt between the maximum charging length of time tmax, and the minimum charging length of time tmin is Δt=tmax−tmin, and Δt is divided into at least two charging length of time intervals with the same charging length of time (t1, t2, t3, t4, tn+1 as illustrated), that is, Δt are equally divided into n intervals, where n≥2; where the respective charging length of time intervals correspond to different digital signals of common voltage (V1, V2, V3, V4, . . . , Vn+1, thus resulting in a correspondence relationship table between charging length of time intervals t of pixels, and digital signals Vcom of common electrode (as illustrated in FIG. 4). With the charging length of time Vcom of the current row of pixels determined in the step S101, the correspondence relationship table as illustrated in FIG. 4 is searched in the step S102 for the digital signal Vcom of common electrode corresponding to the charging length of time Vcom of the current row of pixels, and the digital signal of common voltage is further converted by the digital-analog conversion circuit into the analog signal of common voltage, thus resulting in the common voltage value corresponding to the charging length of time of the current row of pixels.

Furthermore, in an optional implementation, in the method above for driving a display panel according to the embodiment of this disclosure, difference Δt between the maximum charging length of time tmax, and the minimum charging length of time tmin is Δt=tmax−tmin is equally divided into n intervals, where the particular number of charging length of time intervals into which Δt is divided is determined in such a way that the precision of adjusting the common voltage value is higher in theory as n is larger, so n can be designed as needed, although the embodiment of this disclosure will not be limited thereto.

It shall be noted that a charging length of time of pixels is neither infinitely large nor infinitely small in a real application, but the charging length of time of pixel shall lie into a reasonable range, so in a particular implementation, in the method above for driving a display panel according to the embodiment of this disclosure, a maximum charging length of time tmax and a minimum charging length of time tmin are set the charging length of time of pixels, where the values of tmax and tmin are preset, and particular values of tmax and tmin can be determined according to the performance of the display panel, or another reasonable factor, although the embodiment of this disclosure will not be limited thereto.

Correspondingly in a real application, the adjustment of a common voltage value of each row of pixels is neither infinitely large nor infinitely small in a real application, so there is an adjustment range of the adjustment of the common voltage value, and in an optional implementation, in the method above for driving a display panel according to the embodiment of this disclosure, a maximum common voltage value Vtmax is set for the maximum charging length of time tmax of pixels, and a minimum common voltage value Vtmin is set for the minimum charging length of time tmin of pixels, where a common voltage value of each row of pixels determined according to a charging length of time thereof lies between Vtmin, inclusive, and Vtmax, inclusive. In an optional implementation, the values of Vtmax and Vtmin are optimum common voltage values determined from previous tests, or of course, can alternatively be determined otherwise without departing from the principle of this disclosure, although the embodiment of this disclosure will not be limited thereto.

Furthermore, in an optional implementation, in the method above for driving a display panel according to the embodiment of this disclosure, after the current row of pixels are driven using the common voltage value corresponding to the charging length of time of the current row of pixels, if there is the same charging length of time of a succeeding row of pixels to the current row of pixels, then the succeeding row of pixels will be driven using the common voltage value for driving the current row of pixels; and if there is a different charging length of time of the succeeding row of pixels to the current row of pixels, then the succeeding row of pixels will be driven using a common voltage value corresponding to the different charging length of time.

Optionally, for the succeeding row of pixels to the current row of pixels, if there is a different charging length of time of the succeeding row of pixels, then the different charging length of time of the succeeding row of pixels will be determined, the correspondence relationship table between charging lengths of time, and digital signals of common voltage will be searched for a digital signal of common voltage corresponding to the different charging length of time of the succeeding row of pixels, the digital signal of common voltage will be further converted by the digital-analog conversion circuit into an analog signal of common voltage, thus resulting in a common voltage value corresponding to the different charging length of time of the succeeding row of pixels, and the succeeding row of pixels will be driven using the common voltage value.

In correspondence to the method above, an embodiment of this disclosure further provides the following apparatus.

Referring to FIG. 5, an apparatus for driving a display panel according to an embodiment of this disclosure includes:

a charging time length determining module 31 is configured to determine a charging length of time of the current row of pixels;

a common voltage value determining module 32 is configured to determine a common voltage value corresponding to the charging length of time; and a pixel driving module 33 is configured to drive the current row of pixels using the common voltage value.

Optionally, the charging time length determining module 31 configured to determine the charging length of time of the current row of pixels includes:

a data receiving circuit configured to receive at least one of following parameters:

a distance between the current row of pixels, and a gate driver and/or a source driver on a main board; and a difference in brightness between the current row of pixels, and a preceding row of pixels; and a data calculating circuit configured to calculate the charging length of time of the current row of pixels according to at least one of the parameters above.

Optionally, the common voltage value determining module 32 includes:

a digital signal determining circuit configured to determine a digital signal of common voltage corresponding to the charging length of time; and a digital-analog conversion circuit configured to convert the digital signal into an analog signal.

Optionally, the digital signal determining circuit is configured:

to determine a charging length of time interval including the charging length of time of the current row of pixels; and to determine the digital signal of common voltage corresponding to the current row of pixels according to a correspondence relationship between charging length of time intervals, and digital signals of common electrode.

Optionally, the digital signal determining circuit is further configured to set the correspondence relationship by:

determining the difference $\Delta t$ between a maximum charging length of time tmax, and a minimum charging length of time tmin;

dividing $\Delta t$ into n charging length of time intervals, where n is equal to or greater than 2; and setting a corresponding digital signal of common voltage for each charging length of time interval.

Optionally, the pixel driving module 33 is further configured:

if the charging length of time of a succeeding row of pixels is the same with that of the current row of pixels, to drive the succeeding row of pixels using the common voltage value for driving the current row of pixels.

Optionally, the pixel driving module 33 is further configured:

if charging length of time of a succeeding row of pixels is different from that of the current row of pixels, to drive the succeeding row of pixels using a common voltage value corresponding to the different charging length of time.

Figure 6:
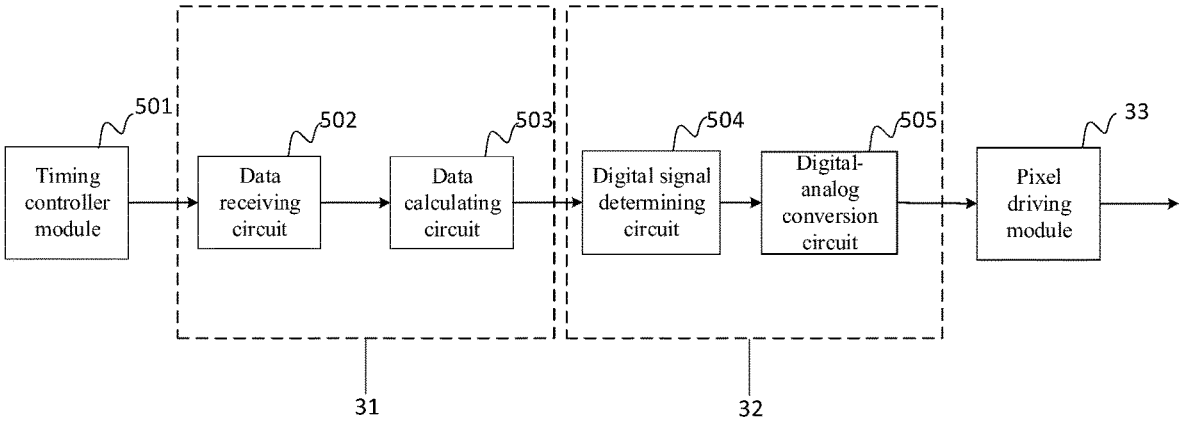
FIG. 6 is a schematic structural diagram of an apparatus for driving a display panel according to an embodiment of this disclosure in details.

Optionally, as illustrated in FIG. 6, in the method above for driving a display panel according to the embodiment of this disclosure, the charging time length determining module 31 can include a data receiving circuit 502 and a data calculating circuit 503.

Optionally, in the method above for driving a display panel according to the embodiment of this disclosure, the data receiving circuit 502 is configured to receive data input by a Timing Controller (T-CON) module 501.

Here, the T-CON module 501 is a component of a driving circuit of the display panel, and the T-CON module 501 converts an image signal in a Low-Voltage Differential Signaling (LVDS) format transmitted by a front-end video signal processing circuit into an image data signal in a Reduced Swing Differential Signal (RSDS) format for peripheral source driver and gate driver integrated circuits of the display panel, and also outputs driving control signal (STV, CKV, STH, CKH, POL) for operation of the source driver and gate driver circuits, so that all these signals are input to the peripheral pixel driver circuits of the display panel, and finally an image is displayed on the display panel.

Furthermore, in an optional implementation, in the method above for driving a display panel according to the embodiment of this disclosure, the data receiving circuit 502 receives data of the entire image input by the T-CON module 501, and the data calculating circuit 503 receives the data of the entire image fed by the data receiving circuit 502, and calculates a charging length of time of each row of pixels according to data of each row of pixels among the data of the entire image. Optionally, the charging length of time of the current row of pixels can be calculated according to at least one of the following parameters:

a distance between the current row of pixels, and a gate driver and/or a source driver on a main board; and a difference in brightness between the current row of pixels, and a preceding row of pixels.

Furthermore, in an optional implementation, as illustrated in FIG. 6, in the method above for driving a display panel according to the embodiment of this disclosure, the common voltage value determining module 32 can include a digital signal determining circuit 504 and a digital-analog conversion circuit 505.

Furthermore, in an optional implementation, in the method above for driving a display panel according to the embodiment of this disclosure, the data calculating circuit 503 calculates the charging length of time of each row of pixel, and the digital signal determining circuit 504 determines a common voltage value corresponding to the charging length of time of each row of pixel input by the data calculating circuit 503 according to the charging length of time of each row of pixel.

Optionally, the digital signal determining circuit 504 sets a maximum charging length of time tmax, and a minimum charging length of time tmin for all the pixels, so the minimum charging length of time tmin is $\Delta t = tmax - tmin$, and the difference $\Delta t$ between the maximum charging length of time tmax, and the digital signal determining circuit 504 divides $\Delta t$ into at least two charging length of time intervals with the same charging length of time (t1, t2, t3, t4, tn+1 as illustrated), that is, $\Delta t$ are equally divided into n intervals, where $n \geq 2$; where the respective charging length of intervals correspond to different digital signals of common voltage (V1, V2, V3, V4, . . . , Vn+1, thus resulting in a correspondence relationship table between charging length of time intervals t of pixels, and digital signals Vcom of common electrode (as illustrated in FIG. 4).

Optionally, in the method above for driving a display panel according to the embodiment of this disclosure, the digital signal determining circuit 504 determines a digital signal of common voltage corresponding to a charging length of time interval of each row of pixels, and inputs the digital signal of common voltage to the digital-analog conversion circuit 505, and the digital-analog conversion circuit 505 converts the digital signal of common voltage into an analog signal of common voltage, thus resulting in the common voltage value corresponding to the charging length of time of the current row of pixels, and inputs the common voltage value to the pixel driving module 33, which drives the current row of pixels.

It shall be noted that FIG. 6 illustrates only an optional embodiment of this disclosure, and the modules or the flow as illustrated may not be necessarily necessary to an embodiment of this disclosure.

Those skilled in the art can appreciate that the modules in the apparatus according to the embodiment of this disclosure can be distributed in the apparatus according to the embodiment of this disclosure as described in the embodiment of this disclosure, or can be modified as necessary, and located in one or more other apparatuses from this embodiment. The modules in the embodiment above can be combined into a module, or can be further divided into a plurality of submodules.

Figure 7:
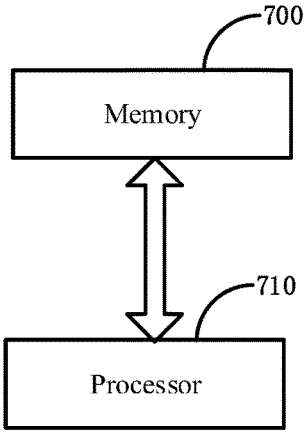
FIG. 7 is a schematic structural diagram of another apparatus for driving a display panel according to an embodiment of this disclosure.

Referring to FIG. 7, correspondingly, an embodiment of this disclosure further provides another apparatus for driving a display panel, where the apparatus includes: a memory 700 is configured to store program instructions; and a processor 710 is configured to invoke the program instructions stored in the memory 700, and to execute the program instructions:

to determine a charging length of time of the current row of pixels;

to determine a common voltage value corresponding to the charging length of time; and to drive the current row of pixels using the common voltage value.

Optionally, the processor is configured to determine the charging length of time of the current row of pixels by:

receiving at least one of the following parameters:

a distance between the current row of pixels, and a gate driver and/or a source driver on a main board; and a difference in brightness between the current row of pixels, and a preceding row of pixels.

Optionally, the processor is configured to determine the common voltage value corresponding to the charging length of time by:

determining a digital signal of common voltage corresponding to the charging length of time; and converting the digital signal into an analog signal.

Optionally, the processor is configured to determine the digital signal of common voltage corresponding to the charging length of time by:

determining a charging length of time interval including the charging length of time of the current row of pixels; and determining the digital signal of common voltage corresponding to the current row of pixels according to a correspondence relationship between charging length of time intervals, and digital signals of common electrode.

Optionally, the correspondence relationship is set by:

determining the difference $\Delta t$ between a maximum charging length of time tmax, and a minimum charging length of time tmin;

dividing $\Delta t$ into n charging length of time intervals, where n is equal to or greater than 2; and setting a corresponding digital signal of common voltage for each charging length of time interval.

Optionally, the processor 710 is further configured: if the charging length of time of a succeeding row of pixels is the same with that of the current row of pixels, to drive the succeeding row of pixels using the common voltage value for driving the current row of pixels.

The processor 710 can be a Central Processing Unit (CPU), an Application-Specific Integrated Circuit (ASIC), a Field-Programmable Gate Array (FPGA), or a Complex Programmable Logic Device (CPLD).

Correspondingly an embodiment of this disclosure provides a computer storage medium storing computer executable instructions configured to make the computer to perform the method above for driving a display panel according to the embodiment of this disclosure.

The computer storage medium can be any computer accessible medium or data storage device including but not limited to a magnetic memory (e.g., a floppy disk, a hard disk, a magnetic tape, a Magnetic-Optical (MO) disk, etc.), an optical memory (e.g., a CD, a DVD, a BD, an HVD, etc.), a semiconductor memory (e.g., an ROM, an EPROM, an EEPROM, a nonvolatile memory (NAND FLASH), a Solid-State hard Disk (SSD), etc.), etc.

Based upon the same inventive idea, an embodiment of this disclosure further provides a display device including the apparatus above for driving a display panel according to the embodiment of this disclosure. The display device can be a mobile phone, a tablet computer, a TV set, a monitor, a notebook computer, a digital photo frame, a navigator, or any other product or component with a display function. All the other indispensable components to the display device shall occur to those ordinarily skilled in the art, so a repeated description thereof will be omitted here, and the embodiment of this disclosure will not be limited thereto.

In summary, with the solutions above according to the embodiments of this disclosure, different common voltage values are determined for pixels with different charging lengths of time, and the corresponding pixels with the different charging lengths of time are driven using the different common voltage values, to thereby address the problem of a flicking image due to the different charging lengths of time so as to display the image uniformly in a display area of the entire display panel, and to improve the uniformity of brightness throughout the display panel.

Those skilled in the art shall appreciate that the embodiments of the disclosure can be embodied as a method, a system or a computer program product. Therefore the disclosure can be embodied in the form of an all-hardware embodiment, an all-software embodiment or an embodiment of software and hardware in combination. Furthermore the disclosure can be embodied in the form of a computer program product embodied in one or more computer useable storage mediums (including but not limited to a disk memory, an optical memory, etc.) in which computer useable program codes are contained.

Evidently those skilled in the art can make various modifications and variations to the disclosure without departing from the spirit and scope of the disclosure. Thus the disclosure is also intended to encompass these modifications and variations thereto so long as the modifications and variations come into the scope of the claims appended to the disclosure and their equivalents.

The invention claimed is:

1. A method for driving a display panel, the method comprising:

determining a charging length of time of a current row of pixels;

determining a common voltage value corresponding to the charging length of time; and driving the current row of pixels using the common voltage value;

wherein determining the common voltage value corresponding to the charging length of time comprises:

determining a digital signal of common voltage corresponding to the charging length of time; and converting the digital signal into an analog signal.

2. The method according to claim 1, wherein determining the charging length of time of the current row of pixels comprises:

calculating the charging length of time of the current row of pixels according to at least one of following parameters:

a distance between the current row of pixels and a gate driver and/or a source driver on a main board; and a difference in brightness between the current row of pixels and a preceding row of pixels.

3. The method according to claim 1, wherein determining the digital signal of common voltage corresponding to the charging length of time comprises:

determining a charging length of time interval comprising the charging length of time of the current row of pixels; and determining the digital signal of common voltage corresponding to the current row of pixels according to a correspondence relationship between charging length of time intervals, and digital signals of common electrode.

4. The method according to claim 3, wherein the correspondence relationship is set by:

determining a difference Δt between a maximum charging length of time tmax and a minimum charging length of time tmin;

dividing Δt into n charging length of time intervals, wherein n is equal to or greater than 2; and setting a corresponding digital signal of common voltage for each charging length of time interval.

5. The method according to claim 1, further comprises: in response to that the charging length of time of a succeeding row of pixels is same with that of the current row of pixels, driving the succeeding row of pixels using the common voltage value for driving the current row of pixels.

6. An apparatus for driving a display panel, the apparatus comprising:

a memory configured to store program instructions; and a processor configured to invoke the program instructions stored in the memory, and to execute the program instructions to perform the method according to claim 1.

7. A non-transitory computer storage medium, storing computer executable instructions configured to make the computer to perform the method according to claim 1.

8. A display device, comprising the apparatus according to claim 6.

9. The apparatus according to claim 6, wherein the processor is configured to invoke the program instructions stored in the memory, and to execute the program instructions to determine the charging length of time of the current row of pixels by:

calculating the charging length of time of the current row of pixels according to at least one of following parameters:

a distance between the current row of pixels and a gate driver and/or a source driver on a main board; and a difference in brightness between the current row of pixels and a preceding row of pixels.

10. The apparatus according to claim 6, wherein the processor is configured to invoke the program instructions stored in the memory, and to execute the program instructions to determine the digital signal of common voltage corresponding to the charging length of time by:

determining a charging length of time interval comprising the charging length of time of the current row of pixels; and determining the digital signal of common voltage corresponding to the current row of pixels according to a correspondence relationship between charging length of time intervals, and digital signals of common electrode.

11. The apparatus according to claim 10, wherein the processor is configured to invoke the program instructions stored in the memory, and to execute the program instructions to set the correspondence relationship by:

determining a difference Δt between a maximum charging length of time tmax and a minimum charging length of time tmin;

dividing Δt into n charging length of time intervals, wherein n is equal to or greater than 2; and setting a corresponding digital signal of common voltage for each charging length of time interval.

12. The apparatus according to claim 6, wherein the processor is configured to invoke the program instructions stored in the memory, and to execute the program instructions to:

in response to that the charging length of time of a succeeding row of pixels is same with that of the current row of pixels, drive the succeeding row of pixels using the common voltage value for driving the current row of pixels.

* * * * *